United States Patent [19]

Dahlem

[11] 4,306,656

[45] Dec. 22, 1981

[54] MEDICAL POUCHES AND A METHOD OF MANUFACTURING SUCH POUCHES

[76] Inventor: A. Richard Dahlem, 1237 E. Main St., Rochester, N.Y. 14609

[21] Appl. No.: 122,310

[22] Filed: Feb. 19, 1980

[51] Int. Cl.[3] ..... B65D 27/10; B65D 85/00

[52] U.S. Cl. ..... 206/390; 206/820; 206/439; 229/69; 156/308.4

[58] Field of Search ..... 206/390, 484.1, 439, 206/484, 820; 229/69; 156/308.4

[56] References Cited

U.S. PATENT DOCUMENTS

| | | | |
|---|---|---|---|
| 2,636,297 | 4/1953 | Johnson | 206/820 |
| 3,254,828 | 6/1966 | Lerner | 229/69 |
| 3,298,580 | 1/1967 | Lerner | 206/820 |
| 3,926,311 | 12/1975 | Laske | 156/308.4 |
| 3,991,881 | 11/1976 | Augurt | 206/439 |

*Primary Examiner*—William T. Dixson, Jr.
*Attorney, Agent, or Firm*—Fred L. Denson

[57] ABSTRACT

A medical pouch comprised of two separate web materials, one web material being notched and cut at an openable pouch end and the second web, along a line aligned essentially with the cut line of the first web, being cut in the line portions overlying the unnotched portions of the first web and serrated in the line portions overlying the notched portions of the first web. The pouches are manufactured by a process including the steps of removing at least one notched zone from one of the webs prior to sealing the two webs together and then cutting through both webs along a transverse line passing through the center of the notched zone, such cutting occurring only in the line portions corresponding to the unnotched areas of the first web and simultaneously serrating the second web along a line essentially conforming to the aforementioned cut line only in the line portions corresponding to the notched zone of the first web.

7 Claims, 4 Drawing Figures

MEDICAL POUCHES AND A METHOD OF MANUFACTURING SUCH POUCHES

FIELD OF THE INVENTION

This invention relates to improvements in medical pouches and methods of forming such pouches. More particularly, the invention relates to an improved process for manufacturing medical pouches in roll form and to the pouches produced by such process.

BACKGROUND OF THE INVENTION

Several types of medical pouches are available in the marketplace. One of the more common types of pouches is manufactured from two separate web materials, one being porous to allow relevant gases or steam to pass therethrough and the other being a transparent, heat sealable film or laminate to allow visual inspection of the pouch contents. Where visual inspection of the contents is unnecessary, an opaque material may be utilized instead of a transparent material. Also, nonporous web materials can be employed for those applications where sterilization is accomplished by methods other than gas or steam (e.g. radiation sterilization). Pouches have been produced for some time in a roll form wherein a plurality of the pouches are initially connected together. An important disadvantage of conventional roll form pouch construction techniques is that they are designed for severing each individual pouch from the roll as it is desired for use and are generally not suitable for sterilization. As will be appreciated by those skilled in the art, individual pouch input is unsatisfactory for automatic, high speed pouch loading and sealing equipment.

In the health care field, manufacturers normally purchase individual medical pouches, banded 100 per bundle in boxes of 1000, more or less, depending on the pouch size so that the corrugated carton weighs less than 40 pounds for ease of handling by the workers. In order to package a device, the operator must first obtain pouches from the bundles and open each pouch one at a time, inserting a device in each pouch followed by sealing of the pouch and repacking the filled pouches for sterilization in suitable corrugated cartons for shipment to the hospitals. Needless to say, such an operation is time consuming.

Currently, the in-hospital packaging systems use bags supplied in boxes of 250, or other count, depending on the pouch size and the supplier's standards. In addition, a continuous roll of 100 feet of "tubing" or "rollstock" comprising a web of porous paper sealed along the outer edges to a laminate of polypropylene to polyester film enables the hospital workers to cut off lengths of rollstock and produce individual pouches. The process is somewhat cumbersome in that the rollstock must be cut from the roll, one cut end must be sealed, the product inserted, and the second cut end must be sealed. This process is repeated for each pouch prepared for sterilization.

U.S. Pat. No. 3,254,828 to Lerner discloses a flexible container strip formed of first and second plies joined together along the sides of the strip. The two plies are transversely sealed together at spaced intervals along the length of the strip so as to define a plurality of containers having closed end portions and opposite end portions. These containers are oriented in the same direction with the opposite end portions of each container being connected to the closed end portion of an adjacent container by one ply having perforations extending transversely thereof. The other of the plies is formed with transverse slit openings spaced along the length of the strip, the slit openings into each container being located adjacent to its opposite end portion. While the Lerner containers provide a number of advantages when utilized in conjunction with automatic loading and sealing equipment, the container construction has several disadvantages when it is desired to have the slit openings overlying the perforated connecting portions. In the manufacture of this type of container, any attempt to sever one ply to form the slit openings prior to the sealing of the two plies together would require complicated ply handling to achieve the desired result. On the other hand, any attempt after the sealing operation to sever one ply completely while simultaneously only perforating the overlying portion of the second ply would require costly specialized and highly accurate equipment.

SUMMARY OF THE INVENTION

Accordingly, it is an object of the invention to provide medical pouches comprised of two separate web materials in roll forms which are readily adaptable to automatic loading and sealing equipment, the pouches having one web material notched and cut at regular intervals defining a pouch length and a second web material which, along a line aligned essentially with the cut line of the first web, is partially cut in the portion overlying the unnotched portions of the first web and partially serrated in the portions overlying the notched portions of the first web.

A second object is to provide pouches in roll form in unit cartons containing 100, 250, or 500 pouches in a roll, suitable for use as in-hospital packaging.

Another object of the invention is to provide a process of manufacturing the above described pouches characterized by the steps of removing at least one notched zone from one of the webs prior to sealing the two webs together to form a plurality of pouches and then cutting through both web faces of each pouch along a transverse line passing through the center of the notched zone, such cutting occurring only in the line portions corresponding to the unnotched areas of the first web and simultaneously serrating the second web along a line essentially conforming to the aforementioned cut line only in the line portions corresponding to the notched zone of the first web.

The medical pouches of the invention offer a number of advantages over known pouches. Since the notched web face is completely severed, the pouch can be easily and fully opened by automatic loading equipment. The partially severed and partially serrated web face provides continuity from one pouch to the next during processing, while permitting ready severability of individual pouches from the roll if desired. The process of manufacturing medical pouches in accordance with the teachings of the present invention also provides a number of advantages over the known prior art processes. The notching of one web prior to the sealing of the two webs together allows the simultaneous complete severing of the notched web and the partial severing and partial serrating of the other web with conventional and inexpensive equipment. In a preferred embodiment, wherein one web is notched at a central web portion and two web edge portions, the subsequently formed serrations in the other web face in the areas overlying the edge notches provide an edge continuity that prevents pouch curl, and increased tensile strength of the serrated web. The edge continuity provides improved processing characteristics, during manufacture of the product, and during filling of the pouches.

The invention, its objects and advantages will become more apparent by referring to the accompanying drawings and to the ensuing detailed description of the preferred embodiment which follows.

DETAILED DESCRIPTION OF THE PREFERRED EMBODIMENT

Figure 1:
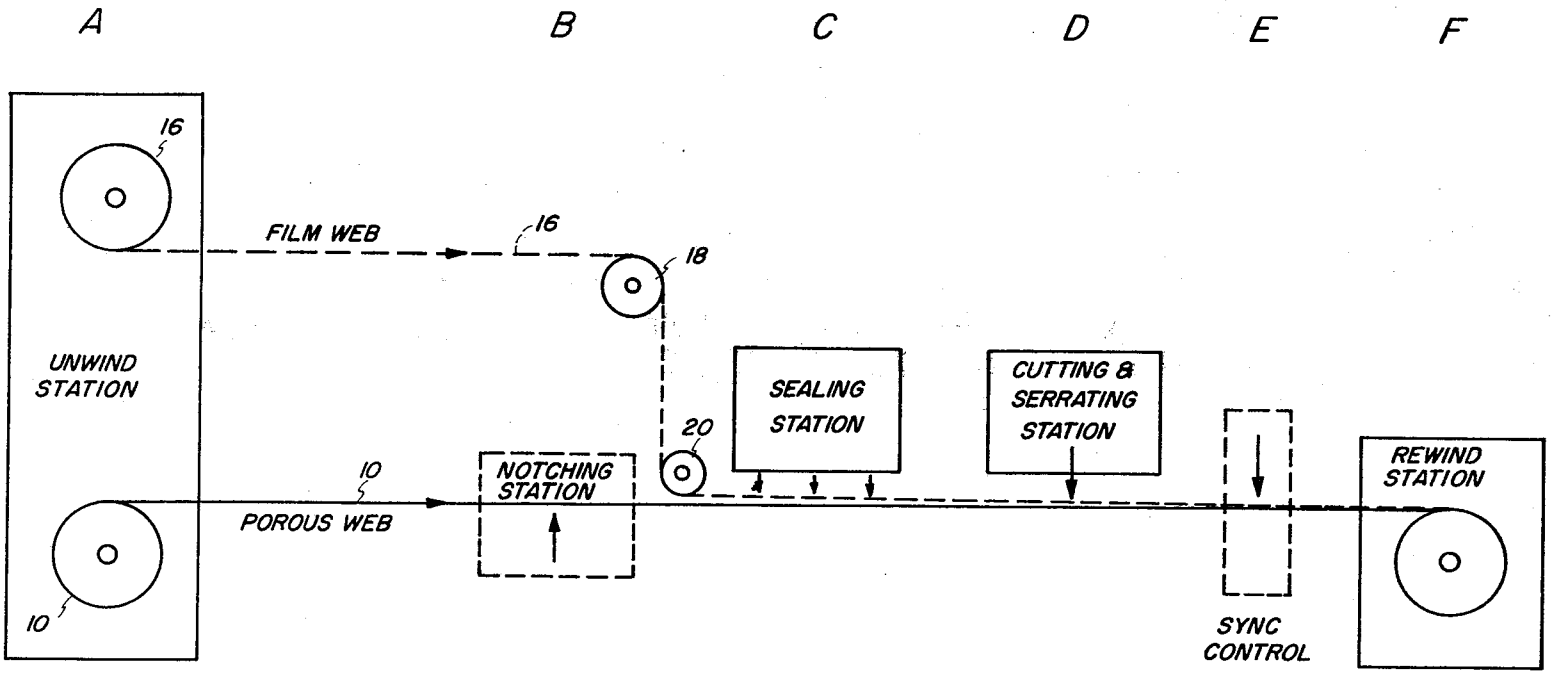
FIG. 1 is a schematic drawing showing diagramatically the processing of two webs to form a plurality of medical pouches in roll form.
Figure 2:
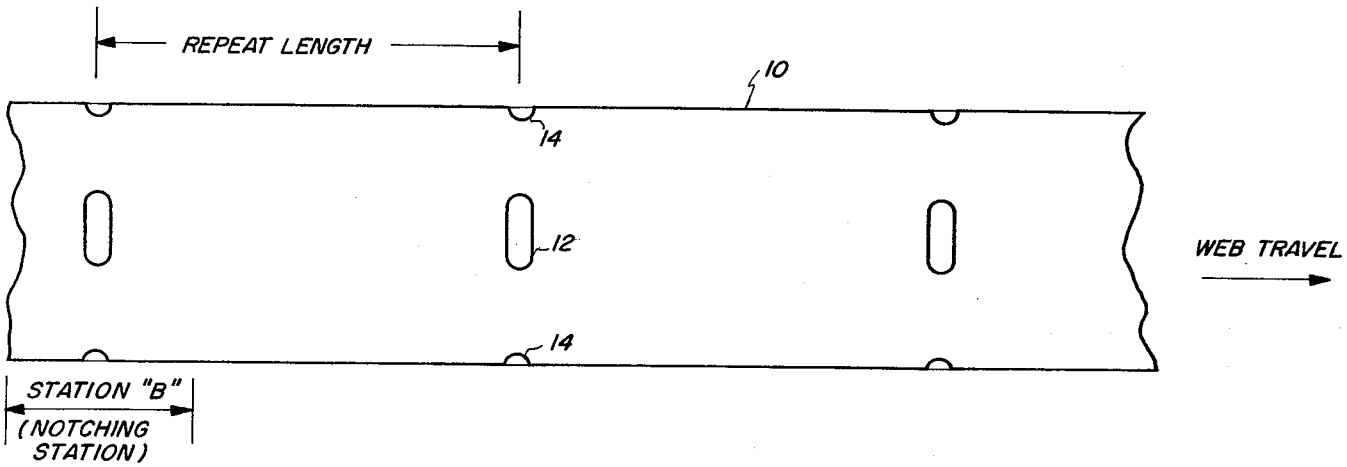
FIG. 2 is a plan view showing the notching of one web at the notching station of FIG. 1.

Referring now to the drawings, a supply roll of porous web material 10, such as paper, is fed from an unwind station A to a notching station B where an elongated central notch or notches 12 and two edge notches 14 are cut at spaced intervals along the length of the web in the manner illustrated in FIG. 2. After the notching operation, the web 10 is fed from the notching station B to a sealing station C.

A supply roll 16 of a heat sealable film laminate material, such as polyester/polyethylene, is also fed from the unwind station A around rollers 18 and 20 to the sealing station C where it overlies the notched, porous web material 10.

Figure 3:
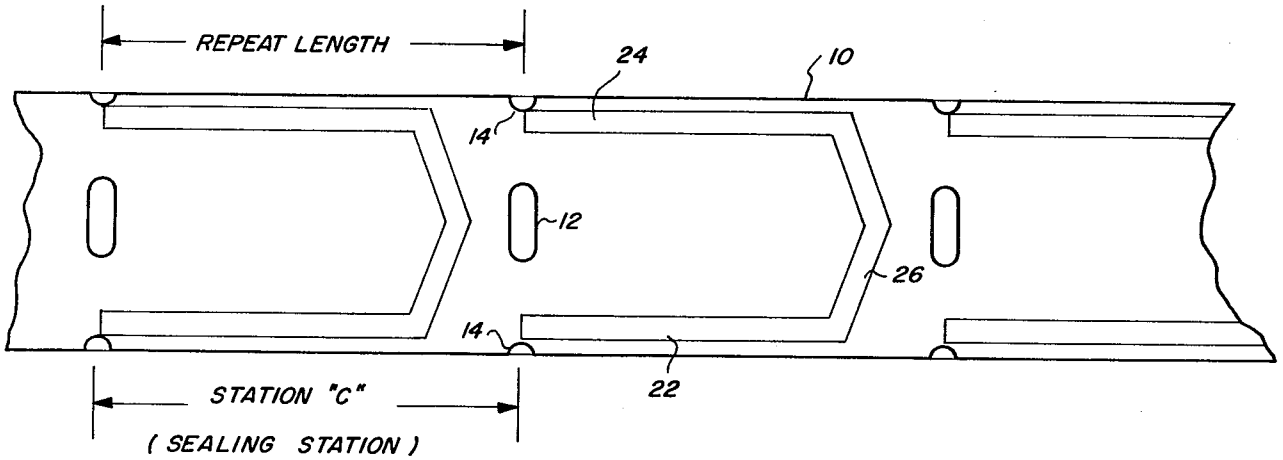
FIG. 3 is a plan view showing the sealing of the two webs together at the sealing station of FIG. 1.
Figure 4:
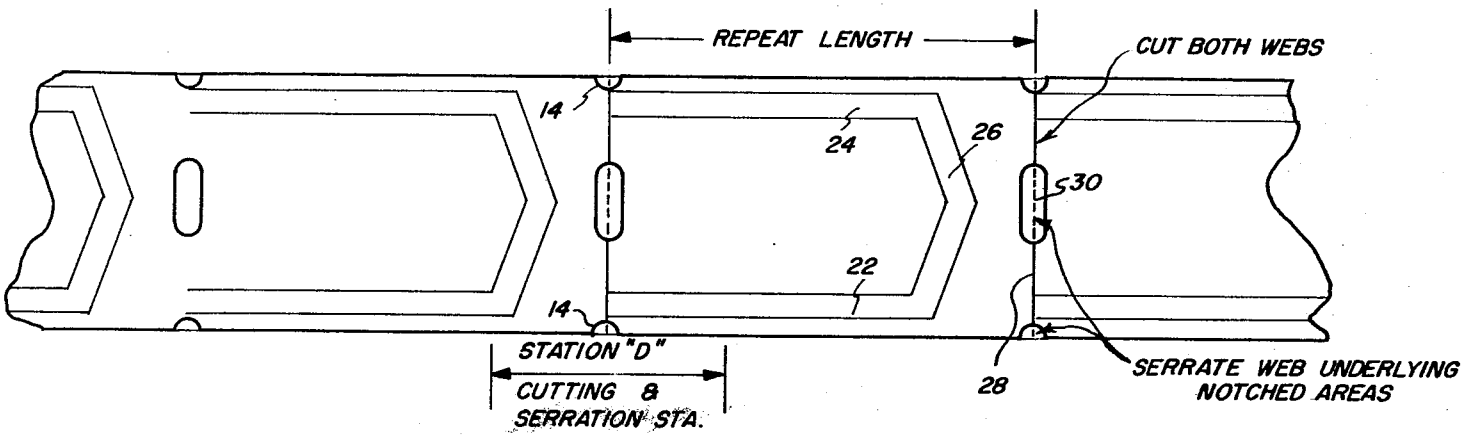
FIG. 4 is a plan view showing the cutting and serrating of the two webs at the cutting and serrating station of FIG. 1.

At the sealing station C the two webs 10 and 16 are heat sealed together in zones spaced along the length of the webs between the notches 12 and 14 cut in the web 10. As best shown in FIG. 3, the sealed web portions comprise the two longitudinal strips 22 and 24, respectively, and a transverse U-shaped strip 26 connecting one end of each of the two longitudinal strips which define the two sides and closed end of a medical pouch. Advantageously, a plurality of pouches are formed by repetitive operative cycles of the sealing station C, all oriented in the same direction.

From the sealing station C, the webs 10 and 16 are advanced to the cutting and serrating station D, where the web 10 is severed along a transverse cut line 28 extending substantially through the centers of the notches 12 and 14. Simultaneously with the severing of the web 10, the web 16 is severed along a line 30 essentially overlying the cut line 28 of the web 10 but only in those portions of the web face 16 corresponding to the unnotched areas of the web 10 and serrated along the same line 30 in those portions of the web face 16 corresponding to the notched areas of the web 10. The severing of the webs 10 and 16 provides an openable end portion for each pouch while the serrations provide a means of connecting adjacent pouches.

From the cutting and serrating station D, the webs 10 and 12 are fed past a sync control station E, which controls the advancement of the webs 10 and 16 and the operative cycles of the various work stations to a rewind station F.

From the above, it can be seen that the present invention provides pouches having improved constructural design and a process for producing such pouches using conventional pouch-making equipment. While the foregoing description and drawings have made reference to a preferred embodiment of the invention which includes medical pouches manufactured from a notched web of porous paper and a heat sealable film laminate web, it is understood that the pouches of this invention can be constructed from a variety of materials which may be bonded together by any one of several known bonding techniques. The two webs may be comprised of the same or different materials. The webs may be made from porous or non-porous materials which may be transparent or opaque. Suitable web materials include film laminates comprising a combination of thermoplastic films such as a polyester/polyethylene made by coextrusion techniques, or by extruding a lower melting thermoplastic film onto a previous extruded thermoplastic film having a higher melting point, or adhesive laminating of two previously prepared films, whether made by blown film techniques, cast-film extrusion techniques or other processes well known in the art of plastic processing. Where a film laminate is employed, one or more of the films in the laminate may be oriented, biaxially oriented or cross-linked by radiation or other means. Other types of suitable film laminates include polyester films coated with heat seal coatings applied by extrusion, latex or solution coating or hot melt techniques. Typical porous materials suitable for use as a web material include bleached, sterilizable Kraft paper, preferably having a base weight between 35 and 45 pounds per ream in the uncoated state or coated with heat sealable latex coatings typically of the EVA (ethylene-vinyl acetate) type; pattern coated, bleached, sterilizable Kraft paper, spunbonded polyolefins such as that produced by E. I. DuPont under the tradename of Tyvek, etc. Transparent film webs may be made from laminates of transparent polyesters with polyethylene, polypropylene and other suitable transparent polyolefins. The polyester/polyethylene combinations generally employ polyester films having a thickness from about 0.5 mils to about 1 mil in conjunction with polyethylene films having thicknesses from about 1 mil to about 2.5 mils. The polyethylene may be extrusion coated or adhesive laminated to the polyester. Other suitable polyester/polyolefin laminates have similar thicknesses and are prepared in a similar manner. Also, unsupported thermoplastic films may be used in place of film laminates where appropriate.

While the foregoing descriptions have made specific reference to heat sealing as the preferred means for joining the two webs, it is understood that other suitable bonding means such as various formulations of natural latex may be used. Typically, heat seals produced with the combinations described herein are peelable, i.e. the two webs may be peeled apart when the pouch contents are to be removed and thus are particularly suitable for use in the health care field. Furthermore, either one of the two webs can be notched and severed provided that the other web is partially cut and partially serrated in the manner taught herein.

The pouches produced in accordance with this invention in roll form and as previously mentioned, are readily adaptable to automatic loading and sealing equipment. Obviously, the time required for device manufacturers to package their devices is substantially reduced. The pouches of the invention are also employed where manual loading operations are involved such as in in-hospital packaging systems. Significant savings in time are attained for such manual operations. These savings are attributable to a large extent to the ease of opening, separating and handling the pouches in roll form. Pouches suitable for manual loading operations are often supplied in a unit container containing the equivalent of multiple, or multiples plus fractions of 100 pouches per roll.

Thus, it will be understood by those skilled in the art that while the articles and process of the invention have been described in detail with reference to preferred embodiments thereof, that variations and modifications can be effected within the spirit and scope of the invention.

I claim:

1. A pouch roll comprising:

(a) a first elongate web having at least one notch cut therein at regular spaced intervals along the web length, said web being cut along a plurality of transverse lines, each of said cut lines passing through substantially the center of one of said notches; and (b) a second elongate web bonded to said first web in a plurality of zones located between the notches of said first web, the bonding in each zone comprising two longitudinal strips and one transverse strip connecting said longitudinal strips, said second web, along a plurality of transverse lines aligned substantially with the cut lines of said first web, being cut along the line portions overlying the unnotched portions of said first web and serrated along the line portions overlying the notches of said first web.

2. The pouch roll according to claim 1 wherein one of said webs comprises a porous material.

3. The pouch roll according to claim 1 wherein said first and second webs comprise different materials.

4. The pouch roll according to claim 1 wherein said first web has one or more central notches and two edge notches cut therein along each of said transverse cut lines.

5. The pouch roll according to claim 1 wherein one of said webs comprises a transparent material.

6. The pouch roll according to claim 1 supplied in a unit container containing the equivalent of multiple, or multiples plus fractions of 100 pouches per roll.

7. A method of manufacturing a series of pouches in roll form from two separate web materials, said method comprising in order the following steps:

(a) cutting in the first of said webs at least one notch at regular spaced intervals along the web length;

(b) bonding the second web to the first web in a plurality of zones located between the notches of said first web so as to form a plurality of pouches having two closed sidewalls and one closed end wall and with all of the pouches oriented in the same direction; and (c) cutting said notched first web along a plurality of transverse lines, each of which passes through substantially the center of one of said notches and simultaneously, along a plurality of transverse lines aligned substantially with said cut lines of said first notched web, cutting said second web along the line portions overlying the unnotched portions of said first notched web and serrating said second web along the line portions overlying the notched portions of said first notched web.

* * * * *